US005551084A

United States Patent [19]

Freese, III

[11] Patent Number: 5,551,084

[45] Date of Patent: Sep. 3, 1996

[54] FIREFIGHTERS PANTS WITH INSULATED CUSHION KNEE

[75] Inventor: George E. Freese, III, Somersworth, N.H.

[73] Assignee: Globe Manufacturing Company, Pittsfield, N.H.

[21] Appl. No.: 350,481

[22] Filed: Dec. 7, 1994

[51] Int. Cl.[6] ..... A41D 13/06

[52] U.S. Cl. ..... 2/23; 2/24; 2/81; 2/DIG. 3

[58] Field of Search ..... 2/2, 22, 23, 24, 2/62, 79, 81, 227, DIG. 3, 2.5

[56] References Cited

U.S. PATENT DOCUMENTS 4,453,271 6/1984 Donzis ..... 2/2.5

FOREIGN PATENT DOCUMENTS 2199233 7/1988 United Kingdom ..... 2/22

*Primary Examiner*—Diana Biefeld

[57] ABSTRACT

A pocket formed on the inside of the knees of a pair of firefighters pants supports a plurality of flexible gas-filled modules which are unconnected to one another and are disposed in abutting relationship to provide a continuous cushion and thermal barrier over the knee cap and surrounding knee area of a firefighter. A detachable closure closes the pocket and allows individual modules to be removed and replaced.

3 Claims, 3 Drawing Sheets

18
10
12
20
22
42
4
64
66
50
52
54
56
38'
68
70
64
66
50
54
52
56
36'
4

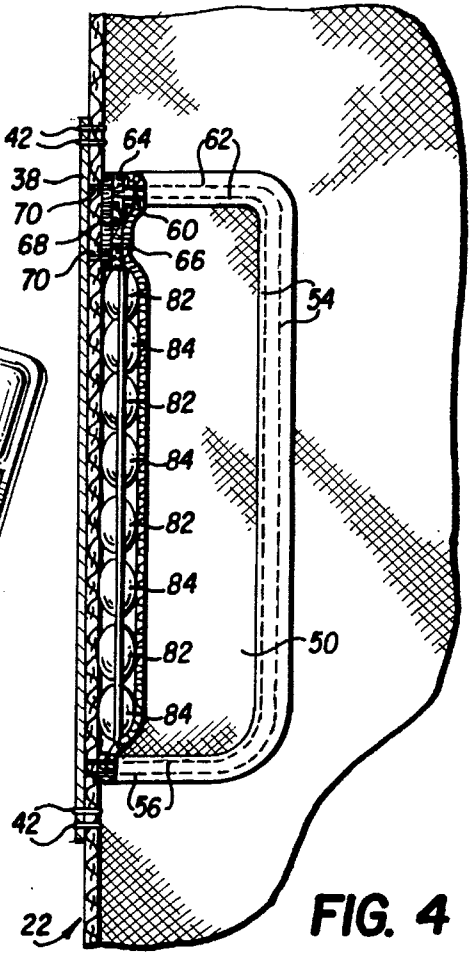
FIG. 4
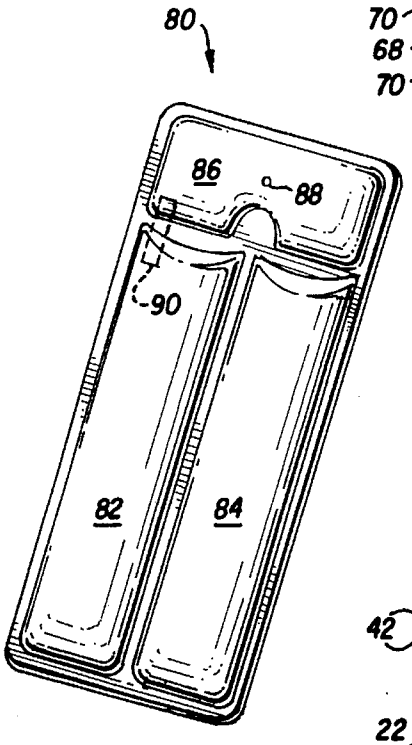
FIG. 5
FIG. 3
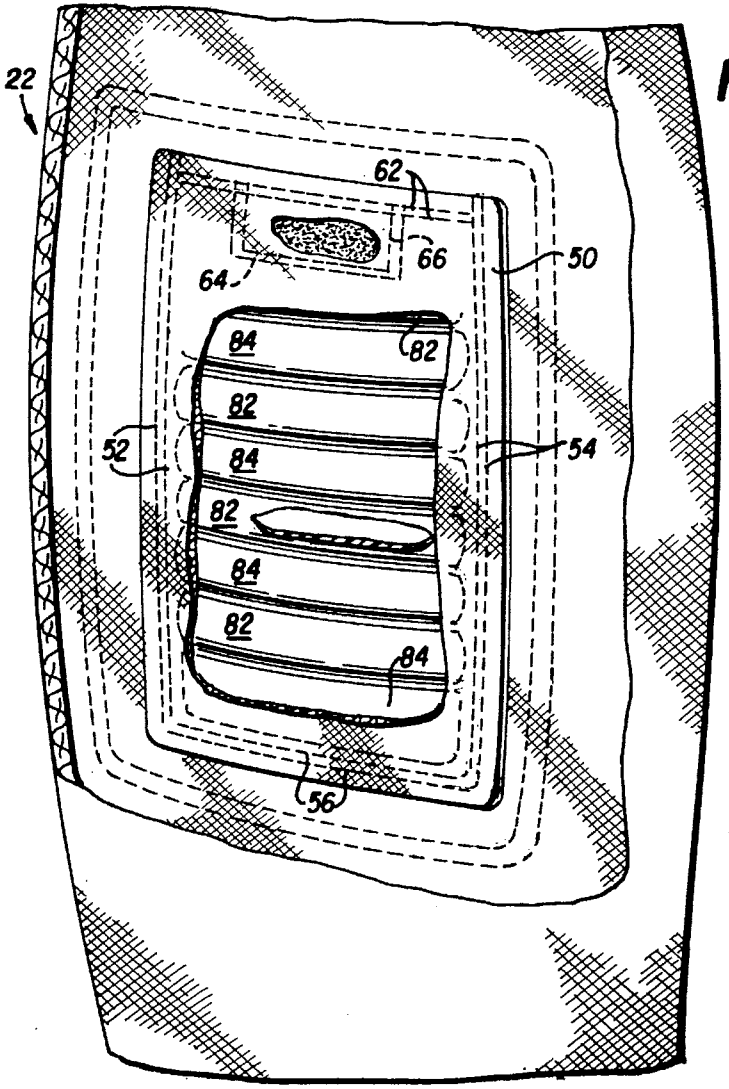

FIREFIGHTERS PANTS WITH INSULATED CUSHION KNEE

BACKGROUND OF THE INVENTION

The present invention relates to firefighters pants and particularly to the knee construction of such pants. During firefighting operations, it often becomes necessary for the firefighter to kneel down or crawl on his hands and knees, thereby applying considerable pressure on his knees. Therefore, it is desirable to provide cushioning means at the knee portions of the pants so as to relieve any discomfort to the firefighter as much as possible.

In addition, it is essential to provide adequate thermal protection to all portions of the pants, including the knee portions. Accordingly, it is desirable to provide cushioning means at the knee portion of firefighter pants which will perform a shock absorbing function, and which further will provide good thermal insulation without significantly adding to the weight of the pants.

SUMMARY OF THE INVENTION

The present invention incorporates a knee construction wherein gas-filled cushioning means is provided at each knee portion to thereby provide the desired shock absorbing function. The gas is preferably air which has good thermal insulating characteristics. The construction is light-weight and economical to manufacture.

The interior of the pants legs are provided with pockets at the knee portions thereof within which are removably supported substantially gas-tight modules filled with gas. The pockets are provided with detachable closure means so that the gas-filled modules are normally held securely in place in the pockets, while permitting such modules to be readily removed if they should be damaged during use or fail for other reasons. Since the pockets are disposed within the associated pants legs, the pockets are protected during firefighting operations by the outer shell of the pants.

BRIEF DESCRIPTION OF THE DRAWINGS

FIG. 3 is an enlarged view of a portion of the structure shown in FIG. 2;

FIG. 4 is a sectional view taken along line 4—4 of FIG. 2; and

FIG. 5 is a top view of a substantially gas-tight module.

DESCRIPTION OF THE PREFERRED EMBODIMENT

Figure 1:
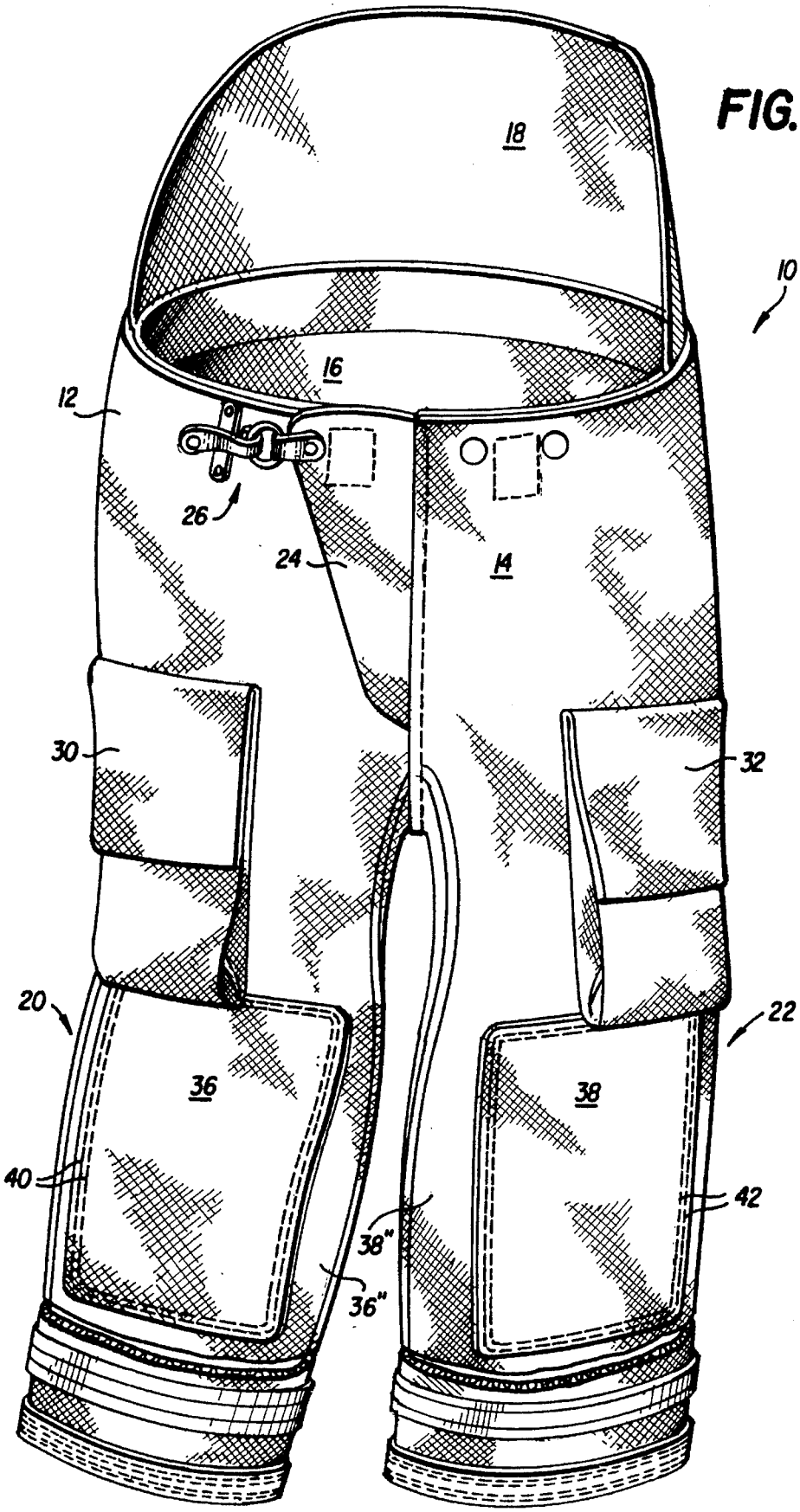
FIG. 1 is a top perspective view of a pair of pants according to the present invention.

Referring now to the drawings wherein like reference characters designate corresponding parts throughout the several views, a pair of firefighters pants 10 is shown in FIG. 1 and includes a torso portion 12 having a front part 14 and a rear part 16. A rear panel 18 extends upwardly from the rear part 16. A pair of leg portions 20 and 22 are connected to the torso portion and extend downwardly therefrom. The front part of the torso portion includes a fly facing 24 and a conventional fastener 26 as well as a pair of conventional exterior pockets 30 and 32. The pants comprise an outer shell of fire resistant material and a removable thermal insulating liner therein as is customary in the art.

The knee portions of the pants legs are each covered by pieces of wear resistant material 36 and 38 which are stitched to the outer outer shell of the pants by double lines of stitching 40 and 42 respectively.

Figure 2:
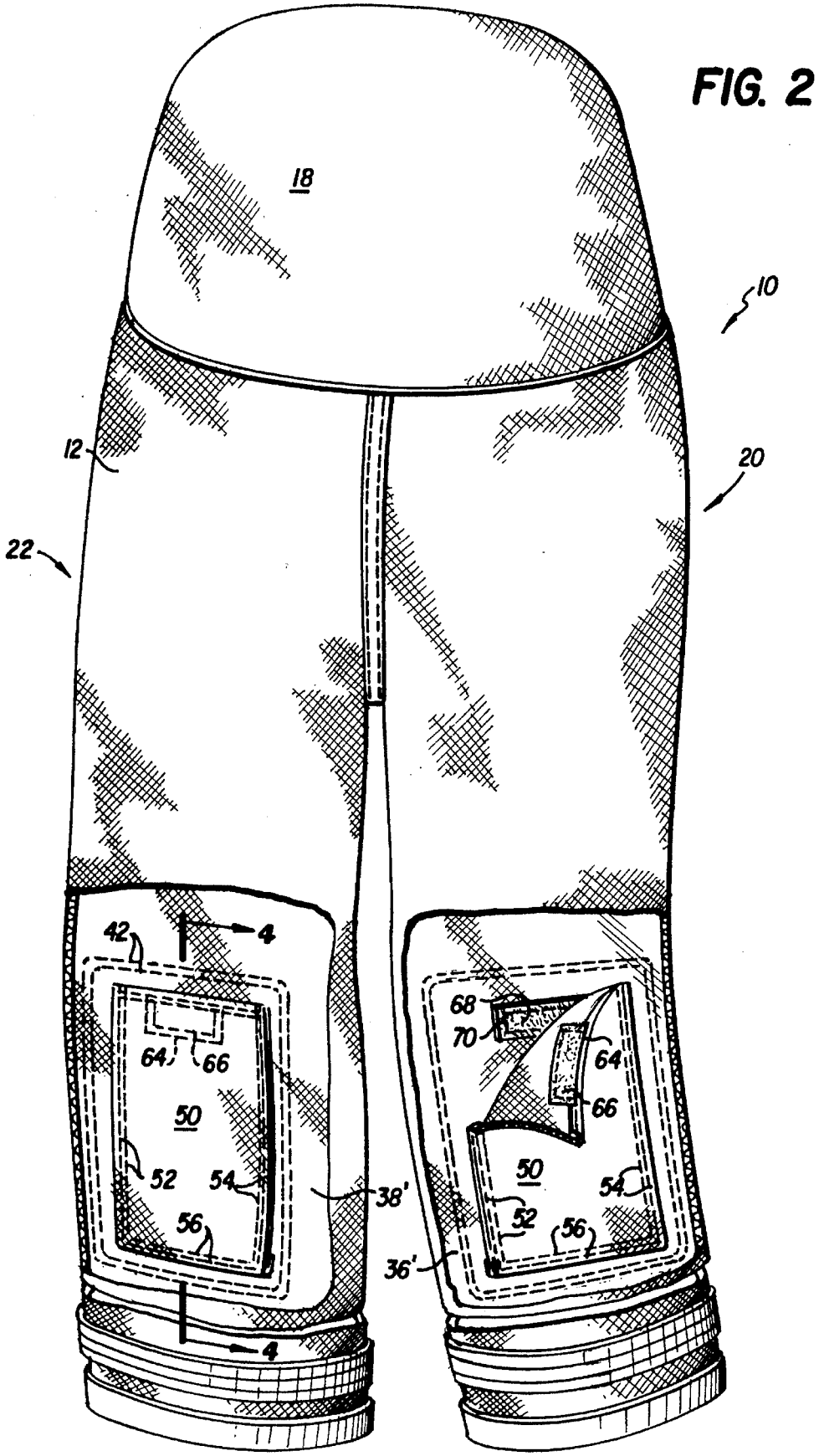
FIG. 2 is a rear view of the pants shown in FIG. 1 with portions broken away.

Referring to FIG. 2, a rear view of the pants shown in FIG. 1 is shown with the rear portions of the pants legs broken away so that the inwardly facing surfaces 36' and 38' of the knee portions at the front of the pants are visible, the outwardly facing surfaces 36" and 38" of such knee portions being seen in FIG. 1. Each of the knee portions is of similar construction, and accordingly a description of the construction of one knee portion will suffice for both knee portions.

Referring to FIGS. 2–4, each knee portion includes a support means in the form of a pocket formed of a piece of material 50 which is stitched to the associated pant leg at the inwardly facing surface thereof by parallel vertical double lines of stitching 52 and 54 which are joined at their lower ends to horizontal double lines of stitching 56 to define a pocket open at the upper end thereof. The upper end of the pocket is defined by a folded over edge 60 as seen in FIG. 4 which is held in place by double lines of stitching 62.

A detachable closure means includes a first member in the form of a generally rectangular piece of hook and loop material 64 such as VELCRO and is secured to the piece of material 50 by stitching 66. The closure means includes a second member in the form of a similar piece of hook and loop material 68 which is secured to the inwardly facing surface of the knee portion by stitching 70 and is positioned so as to interengage with material 64. It is apparent that the closure means enables the pocket to be securely closed, and yet permits the pocket to be readily opened when desired.

Each pocket is substantially filled with gas-filled cushioning means. The cushioning means may comprise a single substantially gas-tight module, or a plurality of modules. A plurality of modules is illustrated and is advantageous since if a single module is damaged, it is only necessary to replace the damaged module while the remaining modules may continue to be used. As seen in FIG. 5, a suitable module is shown which is identified as a two-chambered air module with a self-contained aspiration system. Such modules are commercially available from Safeguard Technologies, Leesport, Pa. The modules are formed of suitable material such as Nylon with a polyurethane liner therein to provide a substantially gas-tight construction.

The module shown in FIG. 5 includes a body 80 including a pair of hollow chamber portions 82 and 84. A pumping portion 86 includes a gas inlet port 88 for receiving ambient air or other gas if desired. The gas enters through port 88 and then passes through a one-way check valve 90 into the hollow chamber portions. The check valve may be of the conventional bladder type. With this arrangement, the module can be manually inflated in a known manner. As seen in FIGS. 3 and 4, a plurality of modules are disposed within the pocket, and the pumping portions 86 of the modules are folded over the chamber portions 82 and 84. The modules are disposed in abutting relationship to one another to provide a substantially continuous cushion and thermal barrier. It is apparent that the construction of the modules could vary, and that a single module could fill the entire pocket if desired.

The invention has been described with reference to a preferred embodiment. Obviously, various modifications, alterations and other embodiments will occur to others upon reading and understanding this specification. It is our intention to include all such modifications, alterations and alternate embodiments insofar as they come within the scope of the appended claims or the equivalent thereof.

What is claimed is:

1. Firefighters pants including a torso portion, a pair of leg portions connected to said torso portion, each of said leg portions having a knee portion for covering the knee cap and surrounding knee area of a firefighter, each of said knee portions including a flexible knee cushion and thermal protection means comprising a plurality of flexible substantially gas-tight modules, said modules being unconnected to one another and being disposed in abutting relationship to one another to provide a substantially continuous cushion and thermal barrier over the knee cap and surrounding knee area of a firefighter and permitting individual ones of said modules to be removed and replaced, and pocket means within each knee portion for supporting said modules in position.

2. Firefighters pants as defined in claim 1 wherein each of said modules has a hollow interior and includes a gas inlet port and a one-way check valve for introducing gas into the interior of the module.

3. Firefighters pants as defined in claim 1 including detachable closure means for closing said pocket while allowing the cushioning means to be removed and replaced.

* * * * *